US008769986B1

(12) United States Patent
DiPietro

(10) Patent No.: US 8,769,986 B1
(45) Date of Patent: Jul. 8, 2014

(54) TESLA ENERGY JEWELRY

(71) Applicant: Jason DiPietro, East Providence, RI (US)

(72) Inventor: Jason DiPietro, East Providence, RI (US)

( * ) Notice: Subject to any disclaimer, the term of this patent is extended or adjusted under 35 U.S.C. 154(b) by 0 days.

(21) Appl. No.: 14/080,086

(22) Filed: Nov. 14, 2013

Related U.S. Application Data

(63) Continuation-in-part of application No. 13/904,846, filed on May 29, 2013.

(60) Provisional application No. 61/755,525, filed on Jan. 23, 2013.

(51) Int. Cl.
*A44C 5/00* (2006.01)
*A44C 17/02* (2006.01)
*A44C 25/00* (2006.01)

(52) U.S. Cl.
CPC ..... *A44C 25/007* (2013.01); *Y10S 63/90* (2013.01)
USPC ..... 63/3.1; 63/31; 63/900

(58) Field of Classification Search
USPC ..... 63/1.12, 11, 3, 15, 3.1, 31, 29.2, 900; D11/3–6
See application file for complete search history.

(56) References Cited

U.S. PATENT DOCUMENTS

| | | | | | |
|---|---|---|---|---|---|
| 14,438 | A | | 11/1883 | Ahn | |
| 393,239 | A | * | 11/1888 | Johnstone | 63/1.12 |
| 401,746 | A | * | 4/1889 | Johnstone | 63/1.12 |
| 421,615 | A | | 2/1890 | Riker | |
| 423,605 | A | * | 3/1890 | Harrington | 63/11 |
| 428,339 | A | | 5/1890 | Howard | |
| 993,303 | A | | 5/1911 | Kirby | |
| 1,019,445 | A | | 3/1912 | Feid | |
| 1,668,217 | A | * | 5/1928 | Schraysshuen | 63/3 |
| D372,680 | S | * | 8/1996 | Salva et al. | D11/4 |
| 5,896,757 | A | * | 4/1999 | Kharloubian | 63/31 |
| D472,177 | S | * | 3/2003 | McCullough-McPherson | D11/4 |
| D474,423 | S | * | 5/2003 | James | D11/231 |
| D487,709 | S | | 3/2004 | Ferlise | |
| D498,167 | S | | 11/2004 | Ferlise | |
| 7,210,313 | B1 | * | 5/2007 | Kay | 63/3.1 |
| D591,634 | S | * | 5/2009 | Gorman | D11/4 |
| D658,085 | S | | 4/2012 | Rafaelian | |
| D658,086 | S | | 4/2012 | Rafaelian | |
| D658,087 | S | | 4/2012 | Rafaelian | |
| D658,088 | S | | 4/2012 | Rafaelian | |
| D658,089 | S | | 4/2012 | Rafaelian | |
| D658,528 | S | | 5/2012 | Rafaelian | |
| D663,232 | S | | 7/2012 | Rafaelian | |
| 8,248,232 | B2 | | 8/2012 | Stevenson et al. | |
| 2006/0137396 | A1 | * | 6/2006 | Ma | 63/15 |
| 2010/0101274 | A1 | * | 4/2010 | Worth | 63/40 |
| 2011/0239702 | A1 | * | 10/2011 | Best et al. | 63/1.18 |

OTHER PUBLICATIONS www.purpleplates.com.

* cited by examiner

*Primary Examiner* — Victor Batson
*Assistant Examiner* — Abigail Morrell
(74) *Attorney, Agent, or Firm* — Salter & Michaelson

(57) ABSTRACT

A tesla energy jewelry product includes a pair of substantially circular bangles that may be placed in juxtaposition to each other. Each substantially circular bangle carries either a tag or decorative charm that is suspended from the substantially circular bangle. Each said tag or decorative charm includes a source of magnetic or tesla energy to provide attractive or repelling forces between the respective tag or decorative charm.

14 Claims, 15 Drawing Sheets

TESLA ENERGY JEWELRY

RELATED CASE

This application is a continuation-in-part of application Ser. No. 13/904,846 filed on May 29, 2013 and which priority for this application was claimed under 35 U.S.C. §119(e) to U.S. Provisional Patent Application No. 61/755,525 which was filed on Jan. 23, 2013, and each of which is incorporated by reference herein in its entirety.

FIELD OF THE INVENTION

The present invention relates in general to jewelry and pertains, more particularly, to various pieces of jewelry or bangles that have been infused with tesla energy to add a new and novel aspect to the jewelry.

BACKGROUND OF THE INVENTION

Various types of jewelry exist. For example, loop-type bracelets are well known and some of these bracelets may even be provided with charms. However, the bracelet itself, as well as the charms, are essentially inert and there is no interaction between adjacent bracelets nor between a bracelet and a charm, tag or the like.

Accordingly, it is an object of the present invention to provide an improved jewelry item and, in particular, a bracelet, although the principles of the present invention may also apply to other jewelry items such as necklaces or pendants. In accordance with the present invention, tesla energy is used as a means by which adjacent bracelets can be attracted or repelled from each other and charms can be affected as to their motion on a bracelet.

SUMMARY OF THE INVENTION

A tesla energy jewelry product is comprised of a pair of substantially circular bangles that may be placed in juxtaposition to each other. Each substantially circular bangle carries either a tag or decorative charm that is suspended from the substantially circular bangle, with each tag or decorative charm including a source of magnetic or tesla energy to provide attractive or repelling forces between the respective tag or decorative charm.

In accordance with other aspects of the present invention the tag or decorative charm is fixedly secured to the bangle; the respective charms each have a jagged edge, and the jagged edges of respective charms are constructed and arranged to matingly engage when the magnetic or tesla energy is applied; the respective charms each have an interlocking edge, and the interlocking edges of respective charms are constructed and arranged to interlock with each other to form a completed charm when the magnetic or tesla energy is applied; the tag or decorative charm is pivotally secured to the bangle; the bangle includes a bangle shaft the tag or decorative charm is constructed and arranged with a loop that extends about the bangle shaft; in combination with a separate energy source that is magnetic or of tesla energy and that is useable to form an attraction between the energy source and the tag or decorative charm to move the tag or decorative charm about the bangle shaft; in combination with a separate energy source that is magnetic or tesla energy and that is useable to form an attraction between the energy source and the tag or decorative charm; and the tag or decorative charm is comprised of an outer ring for rotationally supporting a center piece, the separate energy source for controlling rotation of the center piece relative to the outer ring.

In accordance with another embodiment of the present invention there is provided a tesla energy jewelry product that is comprised of a substantially circular bangle that carries either a tag or decorative charm that is suspended from the substantially circular bangle, said tag or decorative charm including a source of magnetic or tesla energy to provide attractive or repelling forces.

In accordance with still other aspects of the present invention the tag or decorative charm is fixedly secured to the bangle; the decorative charm or tag has an interlocking edge, and the interlocking edge may mate with another decorative charm or tag; the tag or decorative charm is pivotally secured to the bangle; the bangle includes a bangle shaft and the tag or decorative charm is constructed and arranged with a loop that extends about the bangle shaft; in combination with a separate energy source that is magnetic and that is useable to form an attraction between the energy source and the tag or decorative charm to move the tag or decorative charm about the bangle shaft; in combination with a separate energy source that is magnetic and that is useable to form an attraction between the energy source and the tag or decorative charm; the tag or decorative charm is comprised of an outer ring for rotationally supporting a center piece, the separate energy source for controlling rotation of the center piece relative to the outer ring; the tag or decorative charm is a two part piece including a base portion and a removable top portion; and both the base and top portions are magnetic and constructed and arranged for an attractive force therebetween.

In accordance with another embodiment of the present invention there is provided a tesla energy jewelry product that is comprised of a substantially circular bangle having opposed bangle ends and a pair of end caps disposed at the opposed ends of the bangle. The respective end caps include a source of magnetic or tesla energy to provide attractive or repelling forces.

DESCRIPTION OF THE DRAWINGS

In accordance with the present invention there are now set forth in FIGS. 1-11 multiple different versions of the present invention including one or more bangles; the use of a separate energy source; fixed, pivotal and rotational aspects of the tag or charm; the use of a code on the charm, tag or bangle; the use of tesla energy via magnetism along with crystal therapy; and a port arrangement for containing the energy source as part of the bangle configuration, but removable for use in motioning.

DETAILED DESCRIPTION

Figure 1:
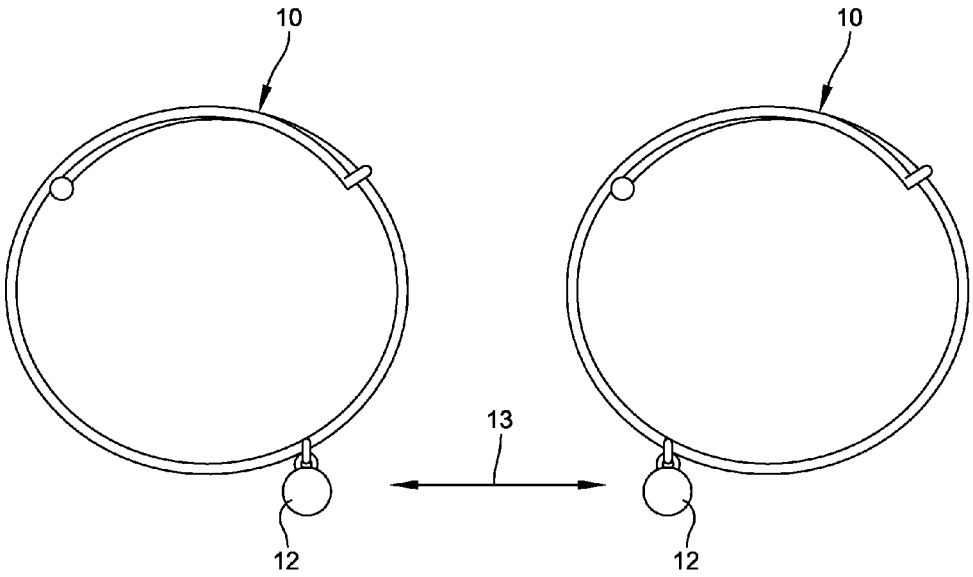
FIG. 1 schematically represents a first embodiment.

FIG. 1 describes a bracelet 10. The construction of this bracelet 10 may be like that shown in U.S. Design Pat. No. D498,167. In addition, various other styles of bracelet, bangle, necklace or pendant may also be employed. FIG. 1 illustrates the tesla energy tag 12 and an arrow 13 shows the attraction between the tags and thus between the bracelets. The tesla energy tags can be directly energized. When the tags are near each other, you can "see" and "feel" their energy force. This energy force is in the form of a magnetism. Thus, the two separate tags 12 illustrated in FIG. 1 may have facing magnets that provide the attraction force. As is known, each magnet has a north pole and a south pole and depending upon how they are situated they can either attract to each other or repel each other. For the most part they should attract. Thus the magnets in the respective tags 12 are constructed and arranged for attraction therebetween.

Figure 2:
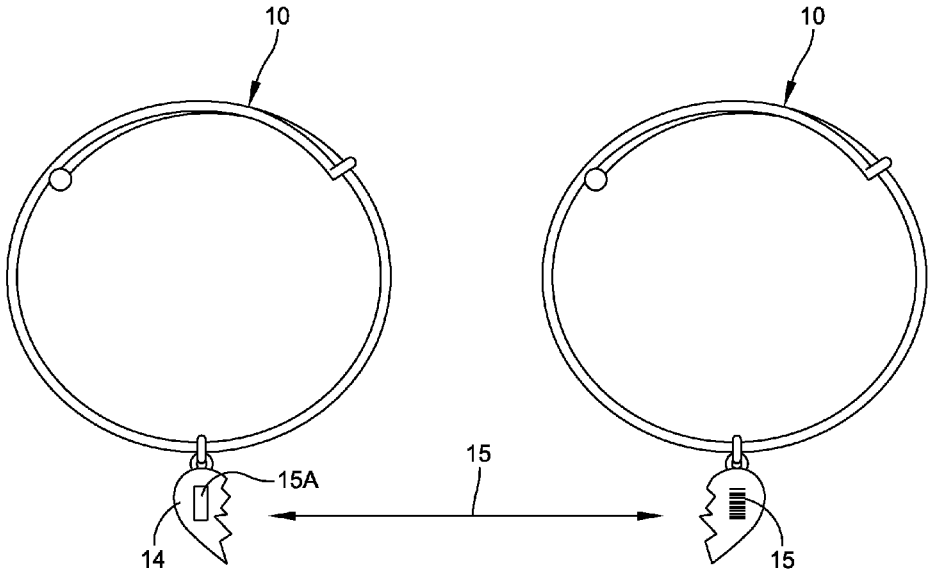
FIG. 2 schematically represents a second embodiment.
Figure 16:
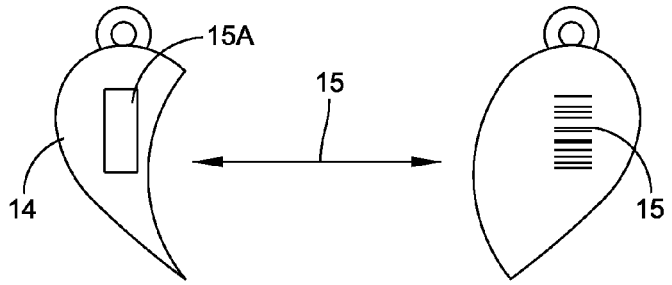
FIG. 16 is a schematic representation of another form of interlocking charm construction.

Refer now to FIG. 2 which also shows the same bracelet arrangement at 10. Also included are flat charms 14. These charms may be directly energized so that when they are near each other they connect (arrow 15) and you can "see" and "feel" the energy between them. It is noted that each of the charms 14 has a jagged edge and when they are attracted to each other, these jagged edges may interlock. This jagged edge interlock is only one of a number of different interlock arrangements that may be provided. In this regard refer to the schematic diagram of FIG. 16 that shows charm portions 14 in which the interlock is by means of an oval surface. In both FIGS. 1 and 2 the tag 12 and charms 14 may be fixedly secured to the bracelet or may be pivoted from the bracelet. Again, magnets are used imbedded in each charm 14 to provide the attraction force. Also, magnets can be provided in the respective bangles 10, such as imbedded in the bangle shaft at a location therealong. FIG. 2 also shows at 15 the use of a bar code on a portion of the charm 14. FIG. 2 also illustrates an option on the left-hand portion of the charm 14 in which an RFID chip 15A is embedded in the charm. Most likely, either the bar code or the RFID chip is used in a single charm.

In FIG. 2 the bar code that is illustrated can contain such information as business contacts, addresses, telephone numbers and in that regard can be used to replace a typical business card. There is thus no need for printing business cards. The bar code can also contain medical information. This would thus provide ready and easy access to medical information. For example, an EMT can scan the charm/bar code and obtain the medical history of a person in the case of an emergency.

Figure 3:
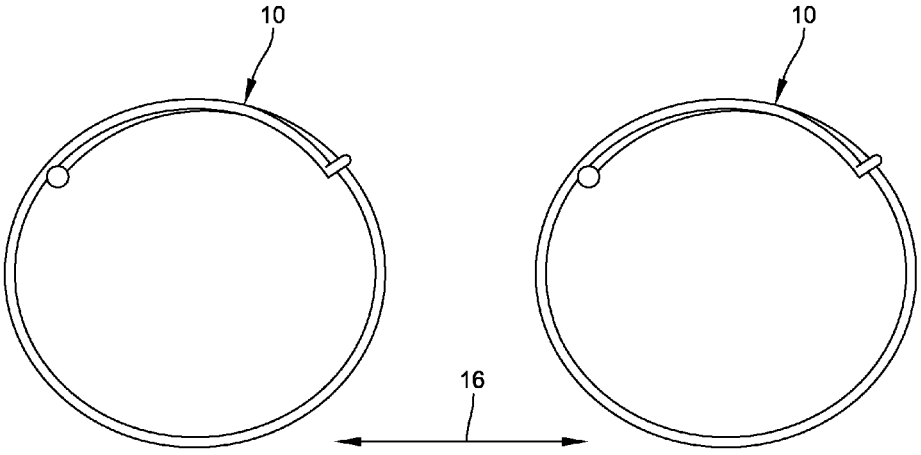
FIG. 3 schematically represents a third embodiment.

Reference is now made to FIG. 3 that also shows the bracelets 10 with coupling energy indicated by the arrow 16. In this embodiment each bracelet or bangle is energized by tesla energy so that when the bracelets are near each other you can "see" and "feel" the energy between them. The bangles are directly infused with tesla energy. This also works for tesla energy therapy wherein the bangles can be constructed and arranged so as to be always in the optimal positioning for energy interconnection. Also, magnets can be provided in the respective bangles 10, such as imbedded in the bangle shaft at a location therealong.

Figure 4:
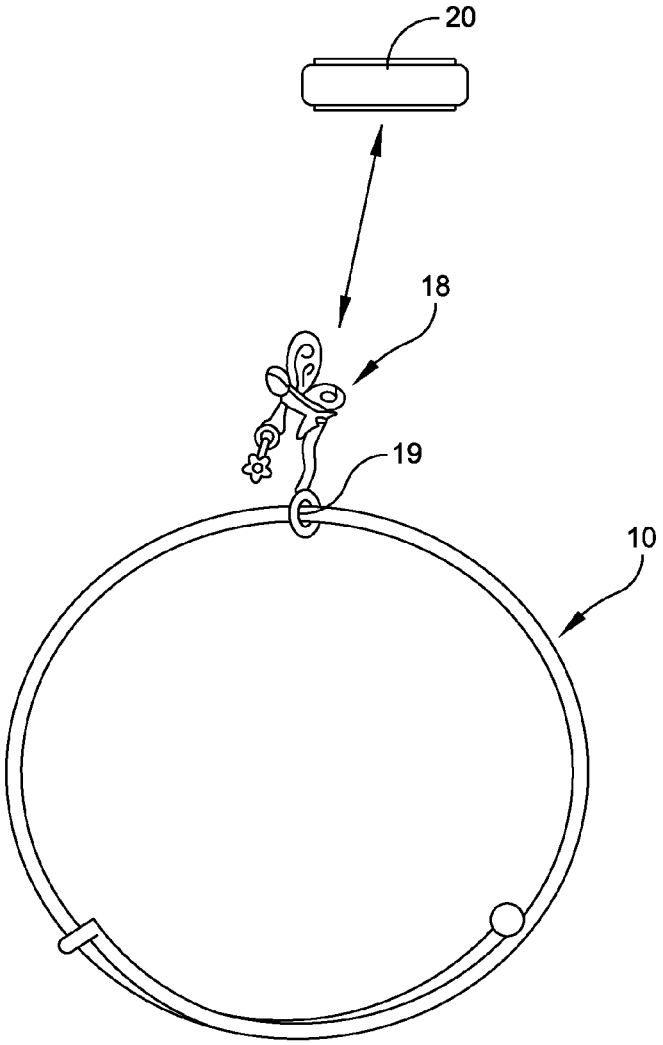
FIG. 4 schematically represents a fourth embodiment.

Reference is now made to FIG. 4 for still another embodiment of the present invention. This shows a single bracelet or bangle at 10 and an energized charm at 18. The charm may take on many different forms and is illustrated as a dancer. The charm 18 is constructed so that it can move at its base 19 about the bracelet. For this purpose the very bottom of the charm 18 may have a hole or passage through which the bangle shaft is arranged. The fit with the shaft is close but allows a sliding motion between the bangle and charm. This movement can be controlled by the external tesla energy power source 20. Another version of this is shown and discussed hereinafter in connection with FIG. 9. In FIG. 4 the connection at 19 enables the charm to move about the shaft of the bracelet under control of the energy source 20. For this purpose a magnet is provided somewhere in or at the charm 18 and another magnet is provided in or at the source 20. The magnets may be rated for different force values depending upon the particular application. By moving the source 20 in an arc close to the charm 18, one can move the charm 18 in a like arc about the bangle shaft.

Figure 5:
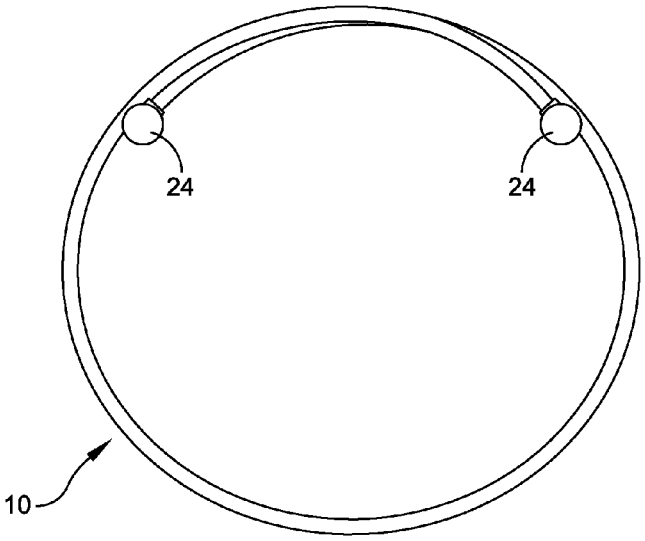
FIG. 5 schematically represents a fifth embodiment.

Refer now to FIG. 5 for another embodiment of the present invention. In this embodiment the bracelet 10 has respective end caps 24. These end caps are energized with tesla energy so that when the bangles are near each other you can "see" and "feel" the energy of the energy force between them. The energized end caps can be plain, decorative or otherwise. The end caps are preferably placed in an optimal area for tesla energy therapy purposes. Magnets may be used imbedded in each end cap 24 to provide the attraction force. Also, magnets can be provided in the bangle 10, such as imbedded in the bangle shaft at a location therealong, or at multiple locations therealong.

Figure 6:
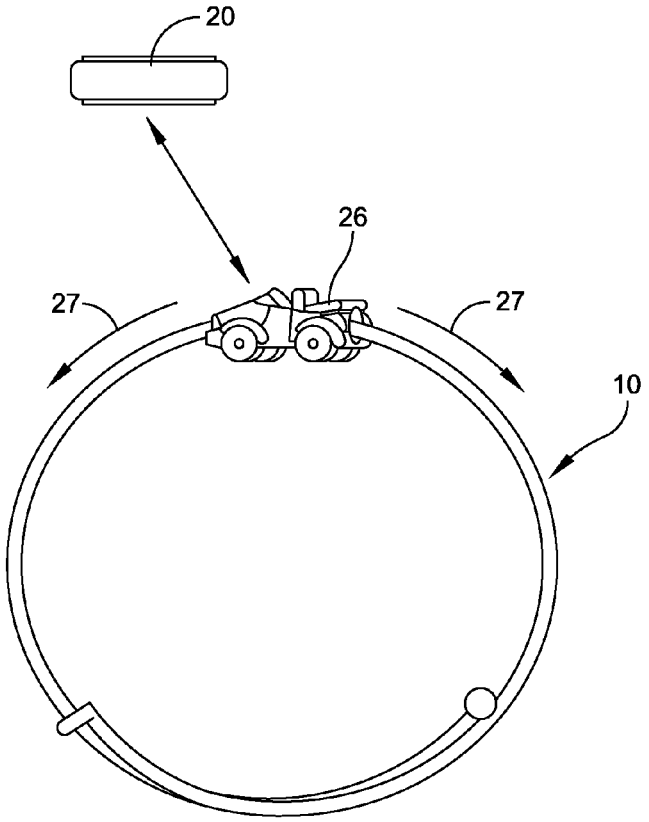
FIG. 6 schematically represents a sixth embodiment.

Reference is now made to FIG. 6 which shows an arrangement similar to that described in FIG. 4 but illustrating a different charm 26. The charm 26 is also connected with the bracelet shaft so that it can rotate in opposed directions such as indicated by the arrows 27 in FIG. 6. This movement is controlled by the tesla energy infused source 20 shown adjacent to the charm 26. There is preferably provided an attractive force between the source 20 and the charm 26 so that the source can be moved to provide a corresponding movement of the charm 26 about the circular path defined by the shaft of the bracelet. For this purpose the charm 26 can be provided with a hole or passage at its base for accommodating the bangle shaft. The fit with the shaft is close but allows a sliding motion between the bangle and charm. This movement can be controlled by the external tesla energy power source 20. For this purpose a magnet is provided somewhere in or at the charm 26 and another magnet is provided in or at the source 20. The magnets may be rated for different force values depending upon the particular application. By moving the source 20 in an arc close to the charm 26, one can move the charm 26 in a like arc about the bangle shaft.

Figure 7:
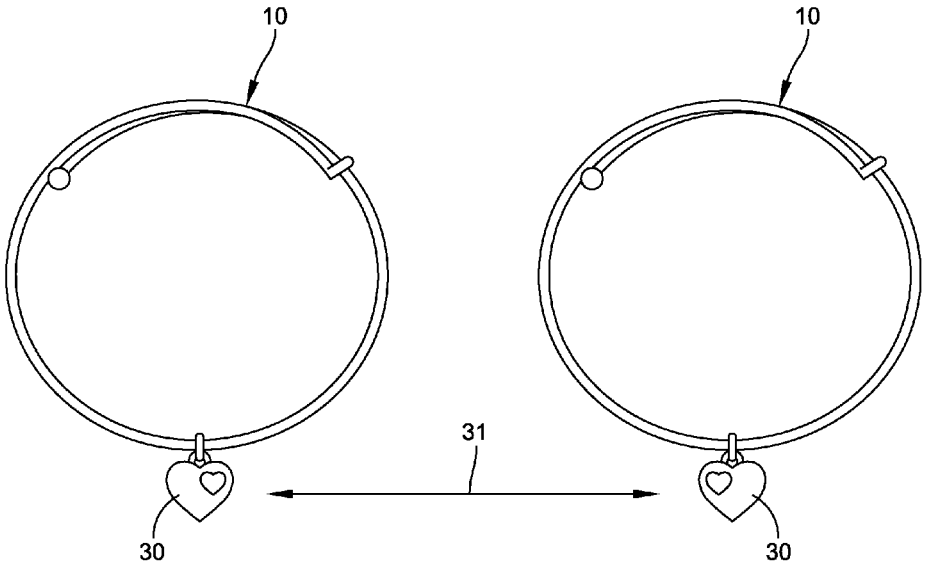
FIG. 7 schematically represents a seventh embodiment.

Refer now to a further illustration in FIG. 7. This includes three dimensional charms 30 that have been infused with tesla energy. In other words these charms have been magnetized with a certain polarity magnetization. They may be magnetized so as to be in an attractive relationship in the direction indicated by arrow 31 in FIG. 7. Each of the charms 30 may be fixed to the bracelet or may be pivoted from the bracelet. For this purpose a magnet is provided somewhere in or at each of the charms 30. The magnets may be rated for different force values depending upon the particular application.

Figure 8:
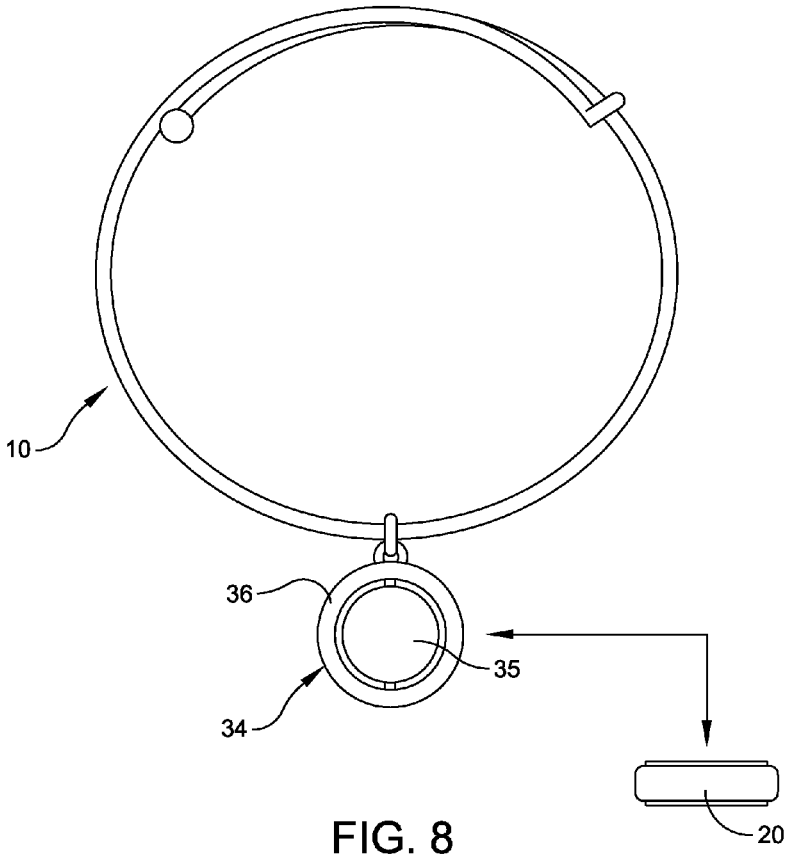
FIG. 8 schematically represents an eighth embodiment.

Refer now to FIG. 8 for an illustration of a charm 34 attached to the bracelet 10. The charm 34 includes a center piece 35 that may be adapted to spin relative to an outer ring 36. The tesla energy source 20 can control the spinning of the center piece 35 when it is put near to the charm. The arrow in FIG. 8 depicts the force field between the source 20 and the center piece 35. By rotating the source relative to the charm 34 one can cause the rotation of the center piece 35 relative to the outer ring 36. The outer ring 36 is preferably fixed to the bangle shaft so that only the center piece 35 rotates based on the force imposed by the source 20.

Figure 9:
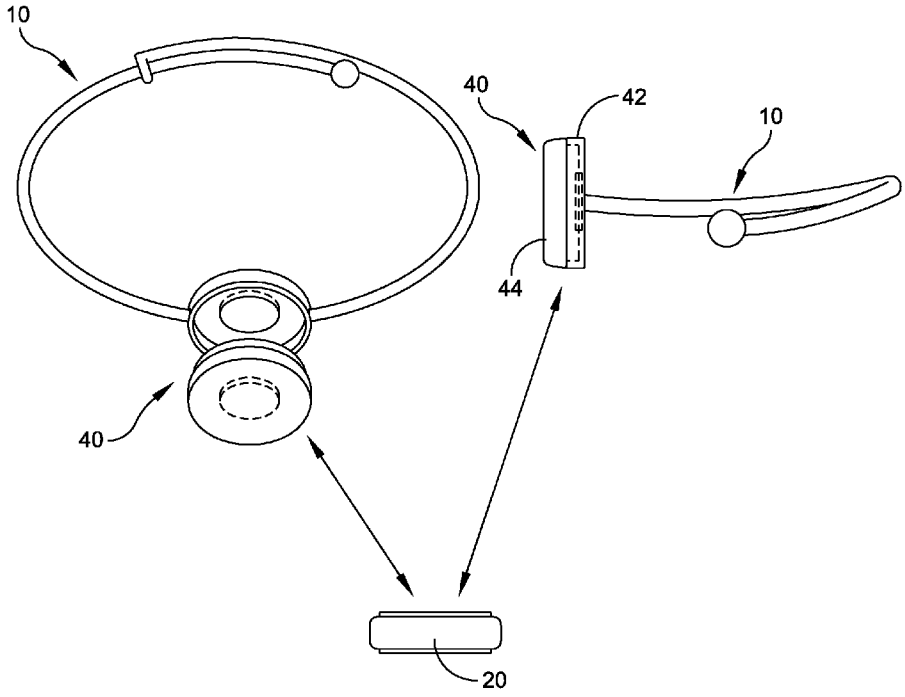
FIG. 9 schematically represents a ninth embodiment.

Reference is now made to FIG. 9 for an important embodiment of the present invention. This also illustrates a bracelet 10 with a charm at 40. This charm is actually a two piece arrangement including a base portion 42 and a removable top 44. The two pieces 42 and 44 are adapted for attraction to each other by the application of tesla energy. Thus a magnet is provided in each of the pieces 42, 44 for providing the needed attraction force. The piece 44 is removable and functions as the tesla energy source 20. This can be used as the energy power source needed to activate charms such as described previously in connection with FIGS. 4 and 6. The exposed surface of the piece 44 may be plain or may be provided as a decoration with a three-dimensional design. This two piece construction can also be associated with a pendant in which one of the pieces can be taken off of the pendant and used as a controlling tesla energy source 20.

Figure 10:
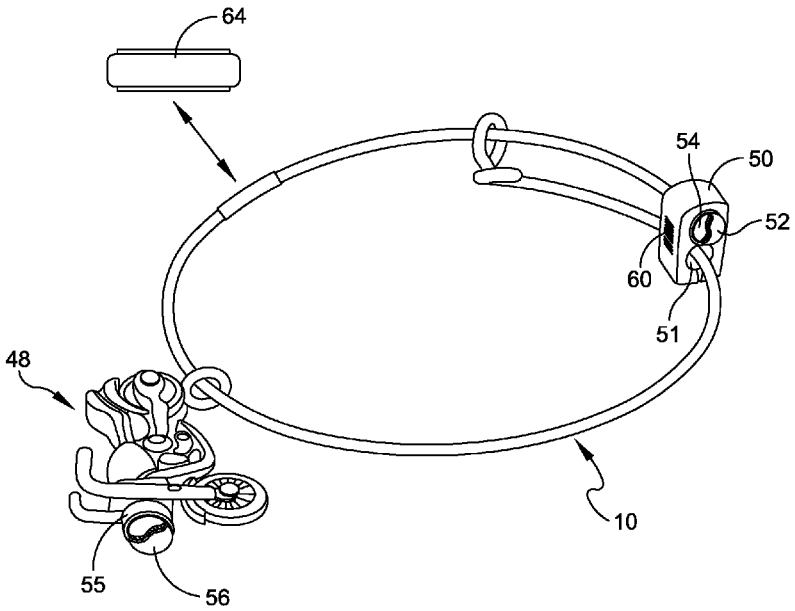
FIG. 10 schematically represents a tenth embodiment.

Reference is now made to FIG. 10 for still another embodiment of the present invention. This shows a single bracelet or bangle at 10 and an energized charm at 48. The charm may take on many different forms and is illustrated as a motorcycle. The charm 48 is constructed so that it either is movable at its base about the bracelet shaft or can be fixed in position or pivotal relative to the bracelet shaft. For this purpose the very bottom of the charm may have a hole or passage through which the bangle shaft is arranged. The fit with the shaft is close but allows a sliding motion between the bangle and charm. This movement can be controlled by the external tesla energy power source 20 that is not shown in FIG. 10. In FIG. 10 the bangle or bracelet includes a base 50 that one part of the bangle shaft extends through a hole 51. The base 50 is of rectangular shape and houses a magnet 52 which is preferably contained behind a crystal 54. This provides a dual effect of the tesla energy and crystal therapy. Likewise the charm 48 may have a magnet 55 imbedded therein and covered by the crystal 56.

FIG. 10 also shows another feature of the present invention of either a code 60 on the base 50 or a code 62 on the bangle shaft. This may be a bar code or any other form of readable code. Also shown is a smart phone at 64 that can be used for reading the code and associating the code with a particular business. The code arrangement described can be used with any of the many versions that have been described herein. An RFID chip may also be used on the base 50, charm 48 or the bangle itself.

Figure 11:
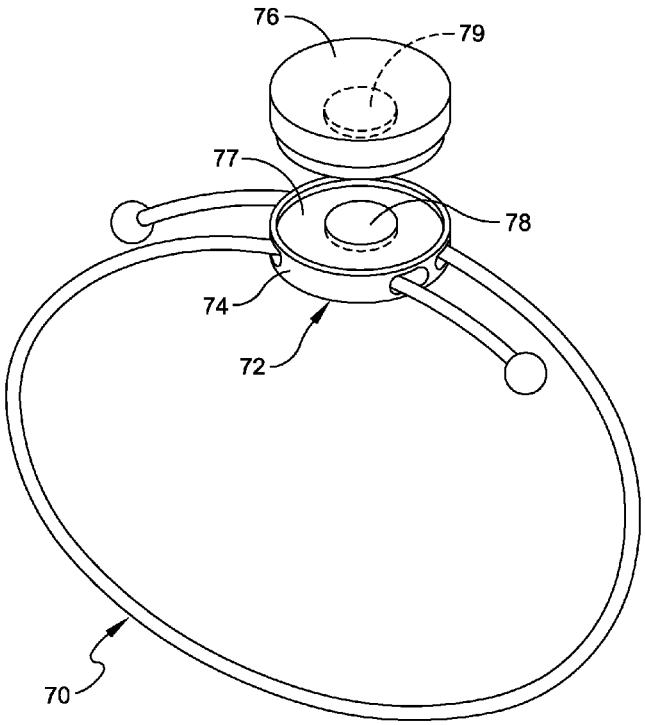
FIG. 11 schematically represents an eleventh embodiment.

Reference is now made to FIG. 11 for still another embodiment of the present invention. This also illustrates a bracelet 70 with a base at 72. The base 72 has side-by-side holes or passages for receiving sections of the bangle shaft. Respective balls may be provided at the free ends of the bangle shaft, as illustrated. This base 72 is actually a two piece arrangement including a base portion 74 and a removable top 76. The two pieces 74 and 76 are adapted for attraction to each other by the application of tesla energy. Thus a magnet is provided in each of the pieces 74, 76 for providing the needed attraction force. The piece 76 is removable and functions as the tesla energy source. This can be used as the energy power source needed to activate charms such as described previously in connection with FIGS. 4 and 6. The exposed surface of the piece 76 may be plain or may be provided as a decoration with a three-dimensional design. This two piece construction can also be associated with a pendant in which one of the pieces can be taken off of the pendant and used as a controlling tesla energy source.

The base 74 preferably has a recess 77 in which the magnet 78 is disposed. At least a part of the top portion or disc 76 is sized to fit within the recess 77. The top portion 76 also contains a magnet 79 that is adapted for coupling with the magnet 78 to provide the attraction force between the base portion 74 and top portion 76. Thus, the top portion can be held by the base but be in readiness for use such as in the version of FIG. 10 wherein the top portion functions as a removable energy source useable to move other items such as a charm or tag or other items. Although not shown in FIG. 11 other charms can be attached to the bangle shaft some of which can contain a magnet for attraction purposes.

Reference is now made to still another embodiment of the present invention illustrated in FIGS. 12-15 that has some of the similarities of the embodiment of FIG. 6 that enables the separate energy source 80 to control the charm 82. The energy source 80 may be similar to that previously described including a magnet M to provide attractive forces. In the embodiment of FIGS. 12-15, the bracelet is illustrated at 84. At one end of the bracelet, there is a ball 85 and a reverse hook or loop 86 that enable that end of the bracelet to be secured with a loop 87 at the opposite end of the bracelet. The loop 87 is formed by a reverse bend through 180 degrees with the very terminal end forming a further loop 88 that is disposed about the bracelet shaft 89 terminating in a ball 91.

Figure 12:
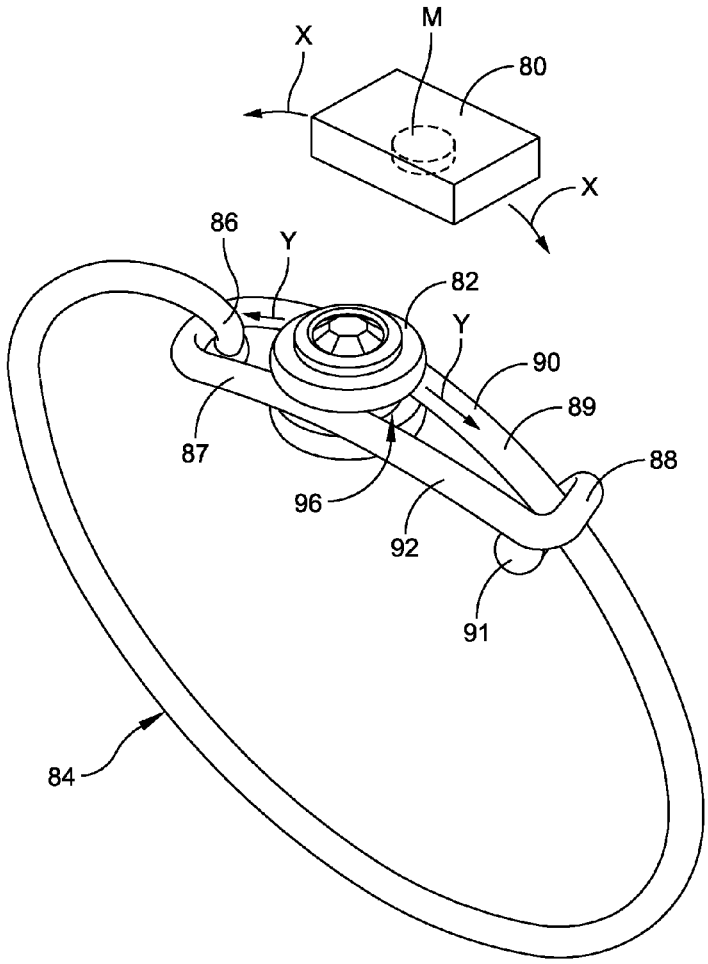
FIG. 12 is a perspective view illustrating still a further embodiment of the present invention wherein the bracelet is in a closed position.
Figure 13:
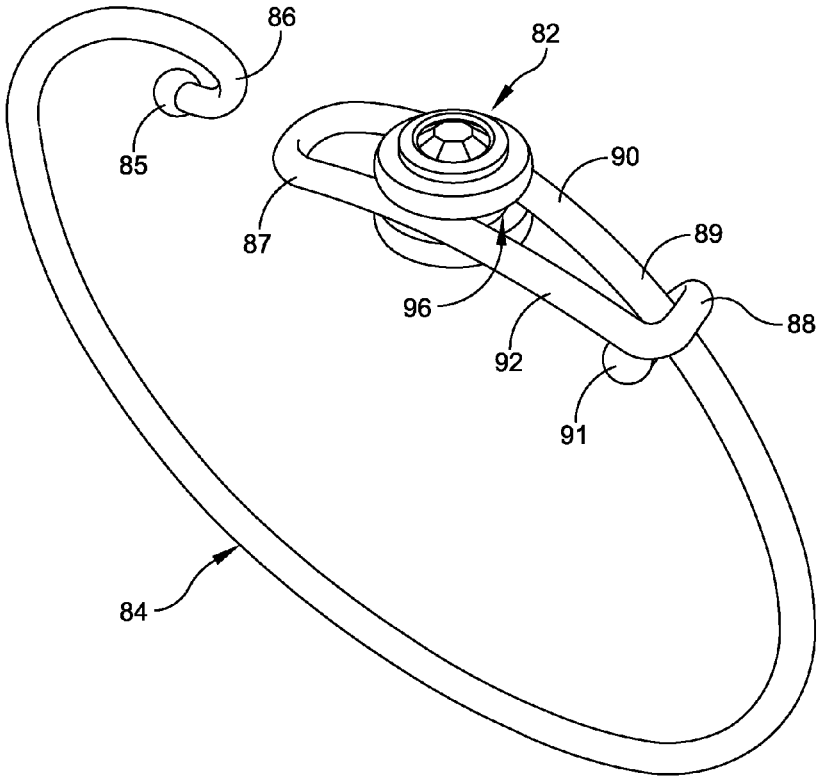
FIG. 13 is a perspective view similar to that shown in FIG. 12 with the bracelet in an open position.

FIG. 12 illustrates the closed position of the bracelet wherein the loop 86 and ball 85 are engaged with the opposite end of the bracelet at the large loop 87. FIG. 13 is a perspective view illustrating the bracelet in an open position wherein the loop 86 has been disengaged from the loop 87. This engagement and disengagement can take place quite easily by simply moving the loop 86 into the loop 87 which may require some deflection of the loop 86 in an upward or downward direction. The loop 86 may be considered as an open loop that enables engagement with the loop 87 which may be considered a closed loop. The loop 87 thus is defined by adjacent spaced apart legs 90 and 92 that define an opening that represents a path for receiving the charm 82.

Figure 14:
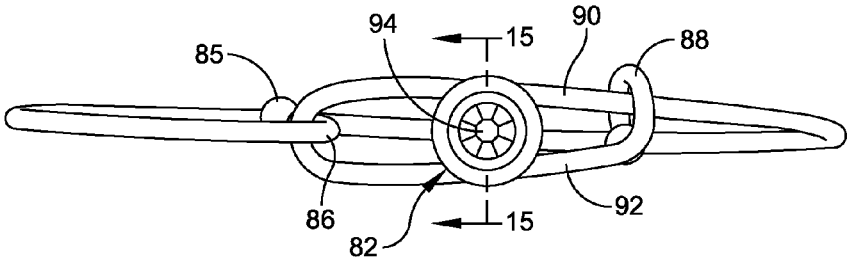
FIG. 14 is a top plan view of the bracelet illustrated in FIGS. 12 and 13.
Figure 15:
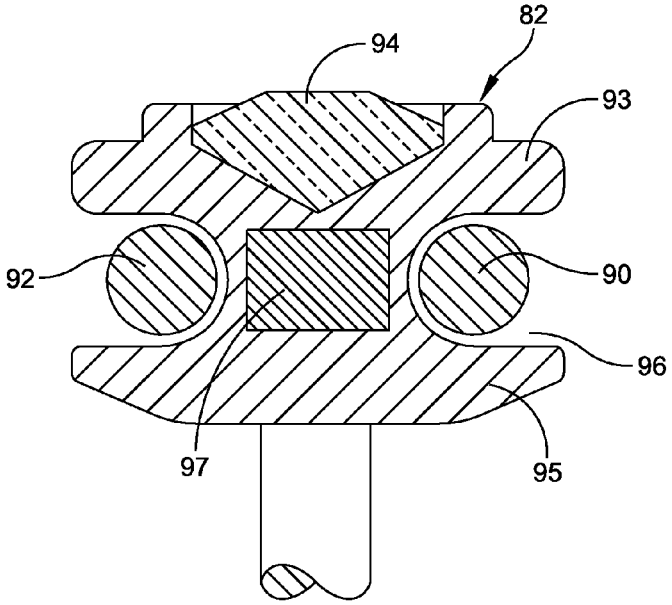
FIG. 15 is a cross-sectional view taken along line 15-15 of FIG. 14.

Reference may now be made to FIGS. 14 and 15 and in particular the cross-sectional view of FIG. 15 that shows further details of the charm 82. The charm 82 has a top section 93 that may support the decorative item 94 such as a piece of jewelry. The charm 82 also includes a bottom section 95 and between the sections 93 and 95 there is provided an annular slot 96. It is the annular slot 96 that rides within the legs 90, 92 and provides a slot track for receiving the charm. The charm is supported in a relatively loose manner but still confined between the legs 90, 92 but is readily able to be moved along these legs under control of the energy source. FIG. 15 also illustrates the embedded magnet 97 that interacts with the energy source 80. Thus, by movement of the energy source 80 in the direction of arrows X, one can cause movement of the charm 82 between and along the legs 90 and 92. This movement is illustrated in the drawings by arrows Y.

Having now described a limited number of embodiments of the present invention, it should now be apparent to one skilled in the art that numerous other embodiments and modifications thereof are contemplated as falling within the scope of the present invention. For example, any of the versions disclosed can be altered with teachings from other versions illustrated herein.

What is claimed is:

1. A magnetic jewelry product comprising:

a substantially circular bangle that includes a substantially circular bangle shaft having opposed ends that releasably interlock to secure the bangle in place;

a decorative charm object or tag object supporting a magnet therein and having one of a slot and passage that defines an object track that is supported by and that engages with the bangle shaft; and a separate energy source that is magnetic and that is useable to form an attraction between the energy source and the decorative charm object or tag object to move the decorative charm object or tag object relative to the bangle shaft;

wherein one end of the bangle includes a hook;

wherein the opposite end of the bangle includes a loop, the loop defined by a curved end portion, a pair of substantially linearly extending spaced apart legs that engage with opposed slot sides of the object track, and a terminal end hook that extends about a portion of the bangle shaft and is spaced from the curved end portion; wherein the decorative charm or tag object is engaged with the spaced apart legs of the loop such that the decorative charm or tag object may be slid along the bangle shaft by the magnetic attraction between the decorative charm or tag object and the separate energy source.

2. The magnetic jewelry product of claim 1 wherein one the slot is an annular slot.

3. The magnetic jewelry product of claim 2 wherein the one end hook includes an end ball.

4. The magnetic jewelry product of claim 1 wherein the length that the legs extend substantially in parallel is greater than the distance between the legs.

5. The magnetic jewelry product of claim 1 wherein the terminal end hook also has a terminating ball.

6. The magnetic jewelry product of claim 1 wherein the substantially circular bangle has the one end hook formed as an open hook and the terminating end hook formed as a closed hook.

7. The magnetic jewelry product of claim 1 wherein the decorative charm or tag object has a top section and a bottom section that define therebetween the object track.

8. The magnetic jewelry product of claim 7 wherein the slot is annular.

9. The magnetic jewelry product of claim 8 wherein the top section of the decorative charm or tag object supports an observable decorative item.

10. A magnetic jewelry product comprising:

a substantially circular bangle that includes a substantially circular bangle shaft having opposed ends that releasably interlock to secure the bangle in place;

a decorative charm object or tag object supporting a magnet therein and having one of a slot and passage that defines an object track that is supported by and that engages with the bangle shaft; and wherein the interlock at the opposed ends is formed by orthogonally directed respective open hook and closed loop, and wherein the open hook is engaged by moving the open hook with limited deflection in an up and down direction relative to the closed loop; and wherein the closed loop is defined by a curved end portion, a pair of substantially linearly extending spaced apart legs that engage with opposed slot sides of the object track, and a terminal end hook that extends about a portion of the bangle shaft and is spaced from the curved end portion;

wherein the decorative charm or tag object is engaged with the spaced apart legs of the loop such that the decorative charm or tag object may be slid along the bangle shaft by a magnetic attraction.

11. The magnetic jewelry product of claim 10 wherein the length that the legs extend substantially in parallel is greater than the distance between the legs.

12. The magnetic jewelry product of claim 11 wherein the terminal end hook extends substantially orthogonal to the closed loop.

13. The magnetic jewelry product of claim 12 wherein the slot is annular and the magnetic jewelry product further includes a separate energy source that is magnetic and that is useable to form the magnetic attraction between the energy source and the decorative charm or tag object to move the decorative charm or tag object about the bangle shaft.

14. The magnetic jewelry product of claim 13 wherein a top section of the decorative charm or tag object supports an observable decorative item.

* * * * *